US007484595B2

(12) United States Patent
Schroeder et al.

(10) Patent No.: US 7,484,595 B2
(45) Date of Patent: Feb. 3, 2009

(54) STEP-SHAPED STAIRCASE LIFT FOR PERSONAL USE AND TRANSPORT OF GOODS

(76) Inventors: Scott Schroeder, 4181 Garatti Ct., Pleasanton, CA (US) 94566; Sharolyn Schroeder, 4181 Garatti Ct., Pleasanton, CA (US) 94566

( * ) Notice: Subject to any disclaimer, the term of this patent is extended or adjusted under 35 U.S.C. 154(b) by 0 days.

(21) Appl. No.: 11/475,506

(22) Filed: Jun. 27, 2006

(65) Prior Publication Data

US 2007/0295561 A1 Dec. 27, 2007

(51) Int. Cl.
*B66B 9/08* (2006.01)

(52) U.S. Cl. ..... 187/200; 187/201

(58) Field of Classification Search ..... 187/200–202; 280/5.2, 5.3

See application file for complete search history.

(56) References Cited

U.S. PATENT DOCUMENTS

| | | | | |
|---|---|---|---|---|
| 2,038,047 | A * | 4/1936 | Johnson | 254/131 |
| 3,724,396 | A * | 4/1973 | Roth | 105/378 |
| 4,029,223 | A * | 6/1977 | Adamski et al. | 414/546 |
| 4,270,630 | A | 6/1981 | Karkau | |
| 4,273,498 | A * | 6/1981 | Dickhart et al. | 414/556 |
| 4,347,030 | A * | 8/1982 | Kingston | 414/556 |
| 4,354,575 | A | 10/1982 | Anderrson | |
| 4,457,402 | A | 7/1984 | Del Vecchio | |
| 4,690,250 | A | 9/1987 | Bergstrom | |
| 4,844,199 | A | 7/1989 | Nimz | |
| 4,971,510 | A | 11/1990 | Houle | |
| 5,072,955 | A | 12/1991 | Holland | |
| 5,261,779 | A | 11/1993 | Goodrich | |
| 5,355,904 | A | 10/1994 | Wallum | |
| 5,363,771 | A | 11/1994 | Warren | |
| 5,373,915 | A | 12/1994 | Trimbley | |
| 5,454,196 | A | 10/1995 | Gaines | |
| 5,624,009 | A | 4/1997 | Benjamin | |
| 5,632,357 | A | 5/1997 | Matre | |
| 5,957,146 | A | 9/1999 | Corey | |
| 6,705,824 | B2 | 3/2004 | Ablabutyan | |

OTHER PUBLICATIONS

Bernard L. Endres; Floor/Safety Report #11: Design For Stair Safety; URL: http://www.ctioa.org/reports/cof11.html; Ceramic Tile Institute of America; Printed Jun. 24, 2006.

* cited by examiner

*Primary Examiner*—Peter M Cuomo
*Assistant Examiner*—Eric Pico
(74) *Attorney, Agent, or Firm*—Gerald R Prettyman

(57) ABSTRACT

A lift using a step-shaped shaft for raising and lowering a person or goods on a platform over one or more steps from one elevation to another elevation. The lift is especially suited for use over porches and raised thresholds of buildings and in and out of vehicles. The lift is suitable for use by persons without or without a wheelchair.

2 Claims, 6 Drawing Sheets

STEP-SHAPED STAIRCASE LIFT FOR PERSONAL USE AND TRANSPORT OF GOODS

FIELD OF THE INVENTION

Various aids assist people in traveling up and down between floors, notably elevators and escalators. These are rarely affordable in most private residential settings where people must walk up and down steps between floor levels. These aids are also not feasible where the rise is only a few inches, or there are few steps.

Many people suffer pain or discomfort relating to the back, hips, legs, or feet, or the bone, musculature or neurological systems relating to these portions of the body. Ascending or descending steps of any rise or number of steps is then a painful and usually slow process. Aids are available in various forms, albeit either stationary intermediate step forms, or electromechanical systems only slightly less complex than elevators and escalators. Stationary intermediate step forms are inexpensive but lack automation and safety measures. The electromechanical systems overcome some problems but are still expensive to the residential owner.

BACKGROUND

The Sphinx asked: "What walks on four legs in the morning, two legs at noon and three at close of day?" Oedipus answered: "Man. A human crawls on four legs as an infant, walks upright on two in the prime of life and hobbles with a cane in old age."

From this, it seems a cane was the first device for assisting the elderly and other persons challenged by the ability to walk. Going up or down stairs is difficult for people suffering from back pain, hip degeneration or disabilities of a neurological and physical nature, such as stroke, multiple sclerosis and other neuromuscular diseases.

For many people, there are few suitable and affordable options. One inexpensive option is to place bricks or blocks of wood or concrete on the steps to decrease the rise between steps. Placed in various configurations, each step becomes two or more intermediate steps. For instance, where the tread run (the front to back depth of the step) might be twelve inches with a six-inch rise, blocks measuring six inches deep and three inches high could placed at the back half of each step to reduce the rise by half. However, this also decreases the tread run the person uses for balance. Maintaining balance is often a related problem on a narrow step so this method is not feasible. There is also the question of where to place the blocks when they are not in use and of who would set up the blocks since the person needing them often cannot do so.

An alternate method is to place the rise sideways on the steps, as shown in U.S. Pat. No. 4,844,199, issued Jul. 4, 1989 to Nimz. The user walks on these intermediate steps to reach the next level. If the blocks were placed serpentine on the stairs, this would be similar to how highway, railway and trailway departments route traffic to mitigate slopes. With U.S. Pat. No. 4,844,199, the user has only one intermediate rise set to work with, which to its advantage has its own built-in banister, but the user must still lift or lower the device from step to step. Also, the tread run must be decreased, or else the overall length of the device is too bulky to move the intermediate steps from one step to another. Thus, as discussed above with the use of half-rise blocks, a person using U.S. Pat. No. 4,844,199 must have the full ability of balance. So besides the slowness of going between full steps, there is the delay of safely moving and orienting the intermediate rise step set. Then there is the question of where to place the device when it is not in use.

Another method is to place a block to one side of each step as shown in U.S. Pat. No. 5,355,904, issued Oct. 18, 1994 to Wallum. The user still raises each foot one full rise of step, but the rise between feet is only a half step. This method is not feasible when a person cannot raise both legs the full rise of the step. Then there is the question of where to place the blocks when they are not in use, the weight of the blocks and how much effort and time are needed to set them up. As discussed above, some people needing such aids may not be able to set them in place. Also, the blocks may need fasteners to avoid slippage, which extends the set up time and effort.

U.S. Pat. No. 5,957,146, issued Sep. 28, 1999 to Corey has a pair of pads supporting a movable banister. While useful for a person who is still able to walk full steps, albeit with support, a person who is unable to lift or lower a leg a full rise cannot use such a device. As with the other personal units, there is the question of where to place the unit when it is in not in use.

Each of these methods also suffers from other problems. One problem is the slowness necessary for the person to move from step to step. In cold, hot or inclement weather, or if a speedy entry or exit is desired, the pain of movement is enough without suffering bodily discomfort or danger as well. Another problem is the lack of safety measures for the user. The consequences of stairway falls are well known but are not sufficiently addressed in these devices in that each device relies on the user's ability to retain her balance while using the device.

Other systems are available to accommodate these needs by bypassing the staircase and also provide for persons with less mobility, such as those persons confined to a wheelchair.

One system converts the staircase into a ramp; see for example, U.S. Pat. No. 5,454,196, issued Oct. 3, 1995 to Gaines. Such a system is mechanically complicated and must either be significantly adapted for home use, or it requires removing an existing staircase. Also, such a system would require a remote control or dual control device for a solitary user.

Another system combines a stairway and hoist to lift a platform at the base of the steps and the steps in an interlocking manner to create a full-length platform at the top level. As the platform lowers, the steps disengage to become steps again while the platform at the base of the steps continues to ground level. See for example, U.S. Pat. No. 5,632,357, issued May 27, 1997 to Matre. As with U.S. Pat. No. 5,454,196 discussed above, such a system is mechanically complicated and must be significantly adapted for home use by removal of the staircase or careful placement over an existing staircase.

Other systems serve as platform elevators beside the staircase and use a variety of elevating methods. One elevating method is similar to using a forklift or front-loading tractor as shown by U.S. Pat. No. 4,971,510, issued Nov. 20, 1990 to Houle. These are called "Vertical Platform Lifts" in the current marketplace, and like the systems discussed above, are generally expensive for the private residence and require customized installation. Another method uses a scissors lift configuration as shown by U.S. Pat. No. 4,457,402, issued Jul. 3, 1984 to Del Vecchio. Another method uses a parallelogram lift configuration as shown by U.S. Pat. No. 5,261,779, issued Nov. 16, 1993 to Goodrich. Another method uses a screw jack to raise the platform as shown by U.S. Pat. No. 5,072,955, issued Dec. 17, 1991 to Holland.

Although suitable for institutional purposes, such units are incongruous to residential use. The systems require custom installation, which is beyond the capacity of many persons requiring such assistance. The complexity of these systems requires trained technicians for installation and service. Furthermore, access beside many staircases is limited and the position of the complex equipment associated with these systems sometimes limits them to uses in specific orientations and locations, i.e., a parallelogram lift requires a clearing to at least one side as well as to the top. As with many complex systems, service failure is a problem that creates discomfort for the delay and undesirable expense for requiring trained technicians to make the repairs. Additionally, many of these latter systems are similar to vehicle lifts as found in service garages and carry the distain of greasy hydraulic mechanisms that are unsuitable for private residential use. Compare for example, U.S. Pat. No. 4,690,250, issued Sep. 1, 1987 to Bergstrom ("Vehicle Lift Bench") to U.S. Pat. No. 6,705,824 B2 issued Mar. 16, 2004 to Ablabutyan ("Wheelchair Lift Device").

Other systems attempt to alleviate some of these problems by installing support tracks and various drive mechanisms over the staircase. One version is U.S. Pat. No. 4,354,575, issued Oct. 19 1982 to Anderrson, which is a Goods Conveyor Track. Another system uses the track as a guide for a user walking up the stairs albeit with some motive assist, as shown by U.S. Pat. No. 5,363,771, issued Nov. 15, 1994 to Warren. While beneficial to the specific applications, these systems lack a solution for a person carrying goods as a user requiring an assist system is sometimes unsteady and balancing goods also while climbing a staircase becomes unsafe.

Other systems include a chair for the passenger to sit in, as shown in FIG. 6 of U.S. Pat. No. 5,373,915, issued Dec. 20, 1994 to Trimbley. However, unless provided with a powerful electrical system, such systems may include a hydraulic system, which is disdainful for private residential use. Although other systems may differ in motive or control systems, another disadvantage is that the track support must bear the weight of the track, chair, user and whatever the user is taking up or down also. Such systems must be mounted to the staircase itself or to weight supporting frames within the home. Consequently, these systems take considerable space away from normal use of the staircase.

For persons using a wheelchair, U.S. Pat. No. 5,624,009, issued Apr. 29, 1997 to Benjamin places the wheels of the wheelchair on a platform attached to tracks projecting from the top of the staircase. The user rolls the wheelchair onto the platform, and then actuates the system to raise, or lower the track as appropriate. The user then rolls off the track and platform to the end travel elevation. However, in the raised position, the user is suspended in the air on the tracks, which may be disconcerting to some people. Also, like the track systems, this wheelchair lift system is complicated and requires an extensive weight bearing support system. Consequently, it is appropriate for lifting a wheelchair bound person between floors, but is not feasible for raising a person or a wheelchair bound person over a small rise of a few steps. As with other large systems, such a system would require a remote control or dual control device for a solitary user.

Other systems are adapted to specific commercial uses, such as lifts for entry and exit from buses. U.S. Pat. No. 4,270,630, issued Jun. 2, 1981 to Karkau incorporates a multiple linkage and platform system. When engaged, the steps of the bus extend and unfold outward to form a platform. The presumably wheelchair bound passenger enters onto the platform, which then rises and retracts to the passenger level of the bus for boarding by the passenger. Such a system is not adaptable for home use without removing an existing staircase.

Each of these systems is expensive and is suitable therefore only where a significant rise is involved or where such a system is required by regulation or necessity, as where the person's mobility is dependent on a wheelchair. Also, few of these systems are truly portable from one staircase to another staircase, or from one elevation of the staircase to another elevation of the same staircase, as with split-level homes. Lastly, the effort and expense of installation and service remove these systems from being suitable for a porch of one or just a few steps, or a raised threshold.

Some systems must be installed to one side of the staircase to lift the user. Other systems must be installed at the bottom or top of the staircase to first vertically lift the user before horizontally moving the user, while yet other systems are installed in place of the staircase.

The economies of scale are appreciated in making larger units or more units, but not for making smaller or a few units. Regardless of size or capacity, existing lift systems are generally too expensive for most private residential locations and are unsuitable for low rise porches and tall thresholds.

What is needed is a personal lift suitable for staircases of one or just a few steps, such as porches and raised thresholds. Other desired advantages include inexpensiveness, ease of adaptability for use, easy installation, ease of service and portability. Adaptability for use with or without a wheelchair is also advantageous.

SUMMARY

The present invention incorporates a platform secured to a Step-Shaped Lift Shaft. The user steps onto the platform and engages the motive source. The motive source partially rotates the Step-Shaped Lift Shaft to move the platform from one elevation of the staircase to another elevation. Stability and safety mechanisms ensure the platform stays level during transition. Once at the desired elevation, power is disengaged and the user can exit the platform. Alternate embodiments provide additional safety and component protection features. An uncomplicated design allows adaptation to most small staircases without expensive adjustments.

DETAILED DESCRIPTION

Figure 1:
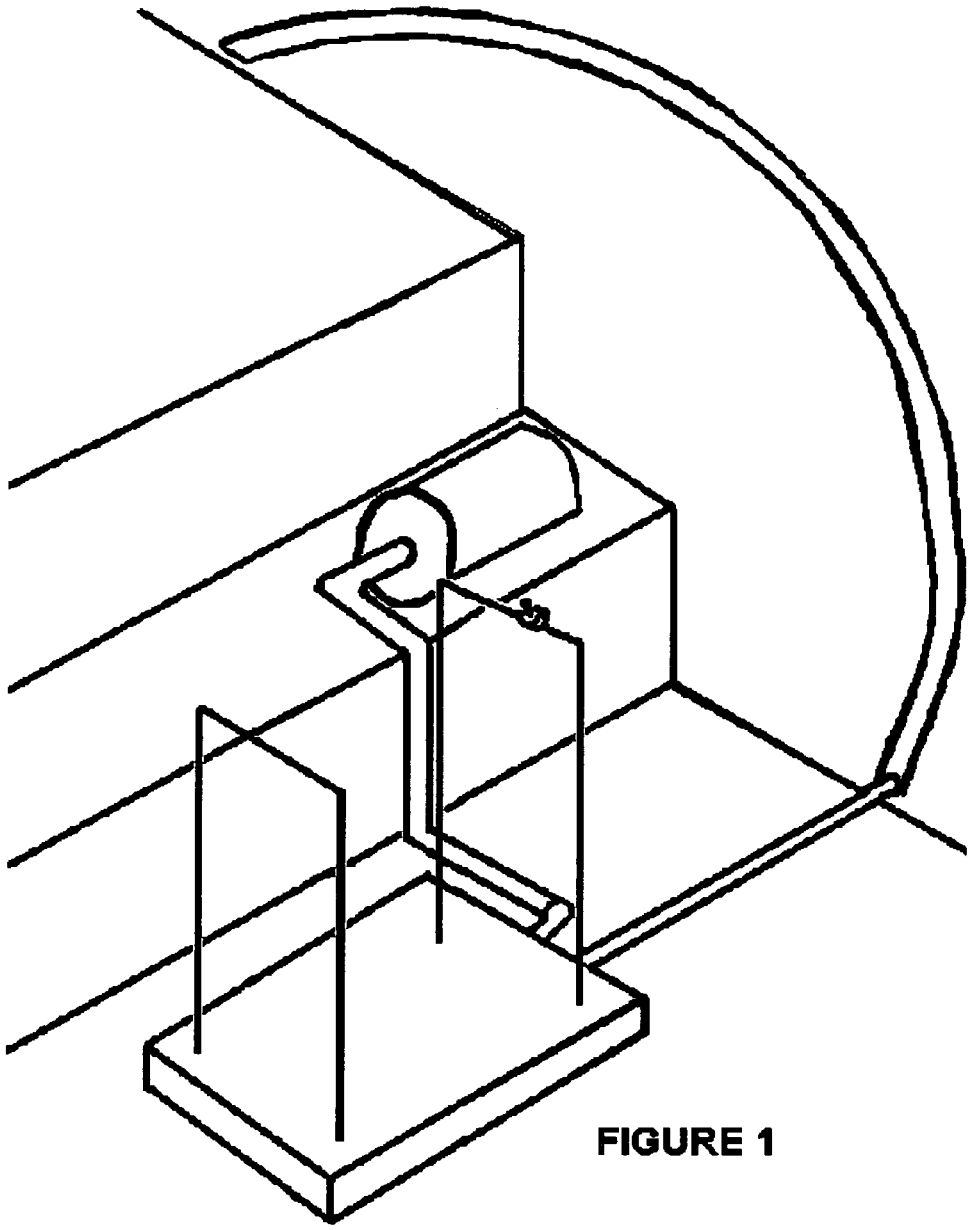
FIG. 1 shows the present invention in perspective view as installed and ready for use.
Figure 2:
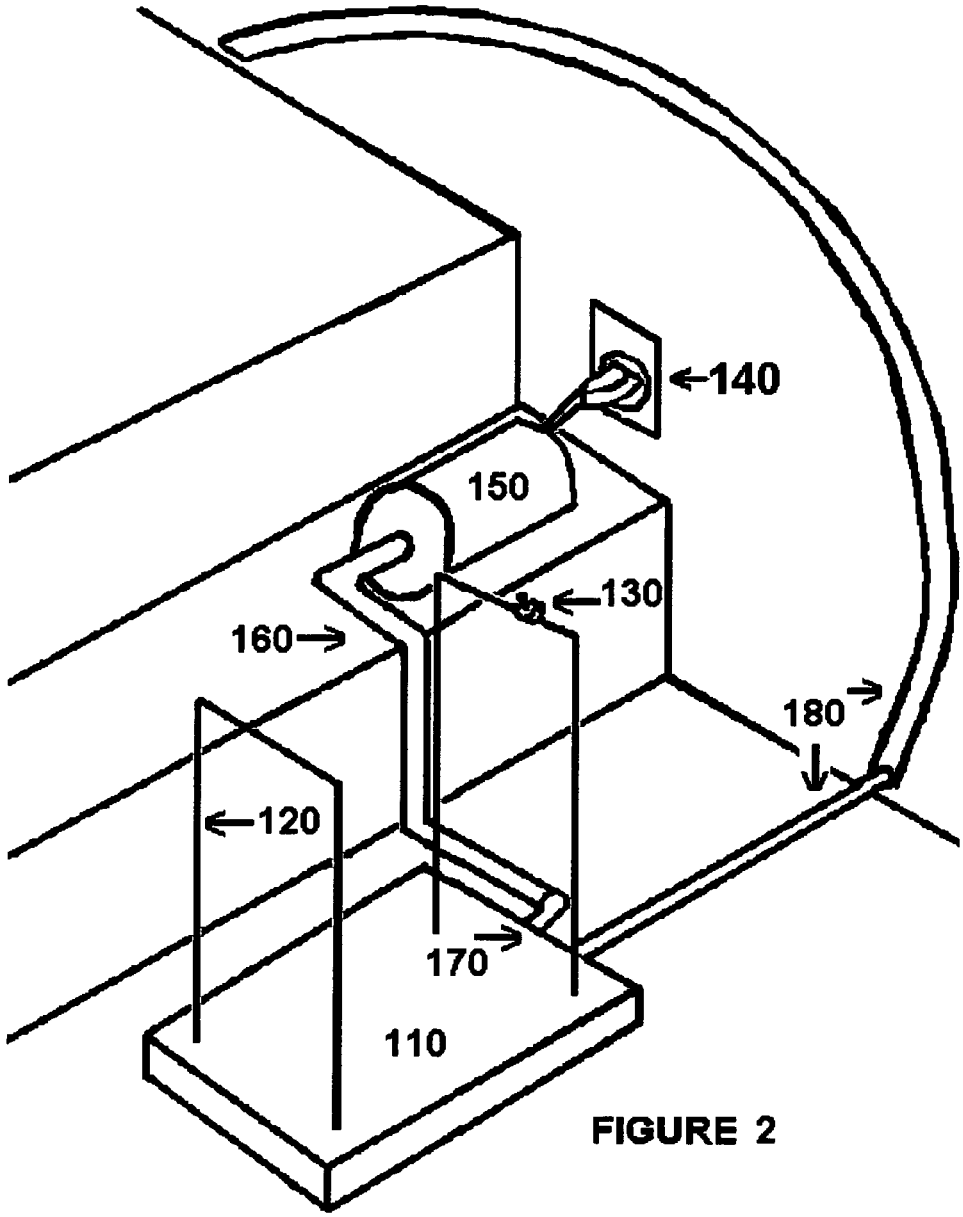
FIG. 2 and its inset
Figure 2A:
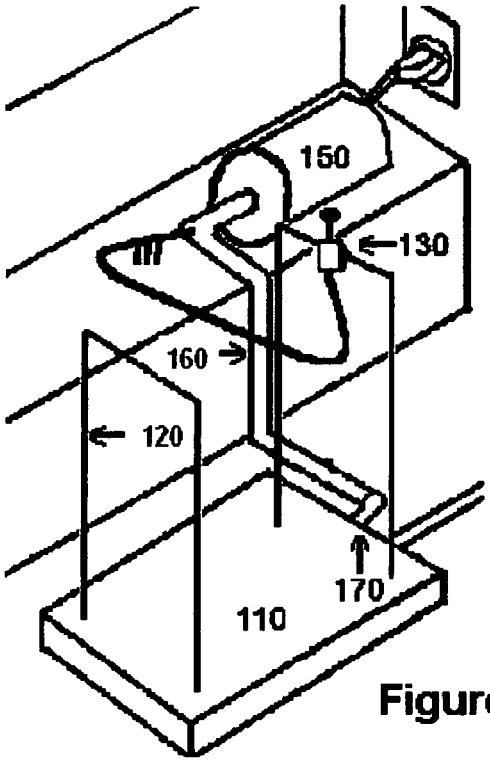
FIGS. 2*a*, 2*b*, 2*c*, and 2*d* is a detailed drawing indicating the individual features of the present invention.
Figure 2B:
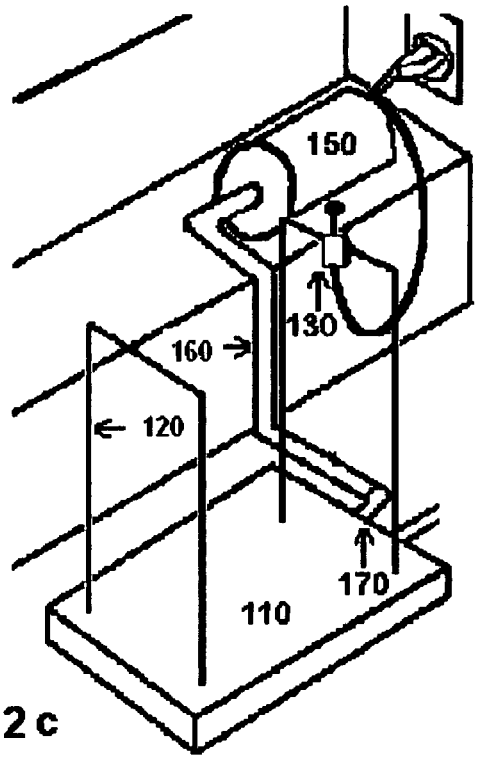
Figure 2C:
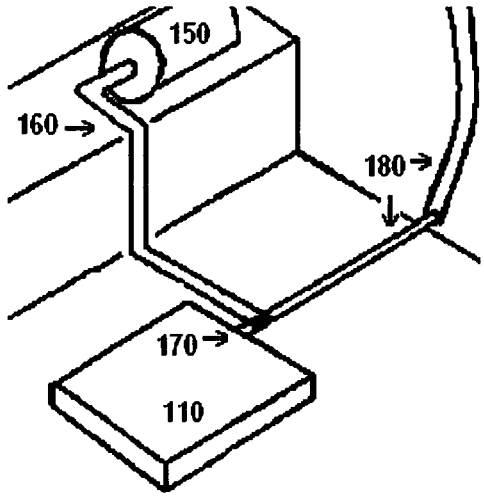

Referring now to FIG. 2 and its inset FIGS. 2*a* and 2*b* showing the present invention as installed and ready for use. The user steps onto Platform 110 and grasps Hand Rail 120. When the user is ready to transit between elevations, the user engages the Power And Direction Switch 130 on Hand Rail 120 to the appropriate position, e.g., "TOP," "UP," "BOTTOM" or "DOWN." Power Supply 140 then engages Motive Source 150 to rotate Step-Shaped Lift Shaft 160 in the direction as indicated by the Power And Direction Switch 130. As Step-Shaped Lift Shaft 160 rotates, Pivot 170 also rotates so Platform 110 can stay level. Pivotable Stability Rail 180 assures that Platform 110 stays level. Power And Direction Switch 130 may be mechanically coupled to the Step-Shaped Lift Shaft 160 to allow the operator a mechanical means of controlling the Step-Shaped Lift Shaft 160 as shown in FIG. 2*a*, or electrically coupled to the motive source as shown in FIG. 2*b*. Pivotable Stability Rail 180 may instead be coupled to Step-Shaped Lift Shaft 160 as shown in FIG. 2*c*. This configuration is suitable for heavy duty use or where an existing handrail or banister allows the user to balance the platform 110.

When the user reaches the desired elevation the user disengages Power And Direction Switch 130 on the Hand Rail 120. This disengages Power Supply 140 from Motive Source 150 to stop rotation of Step-Shaped Lift Shaft 160. The user then exits Platform 110.

Figure 3:
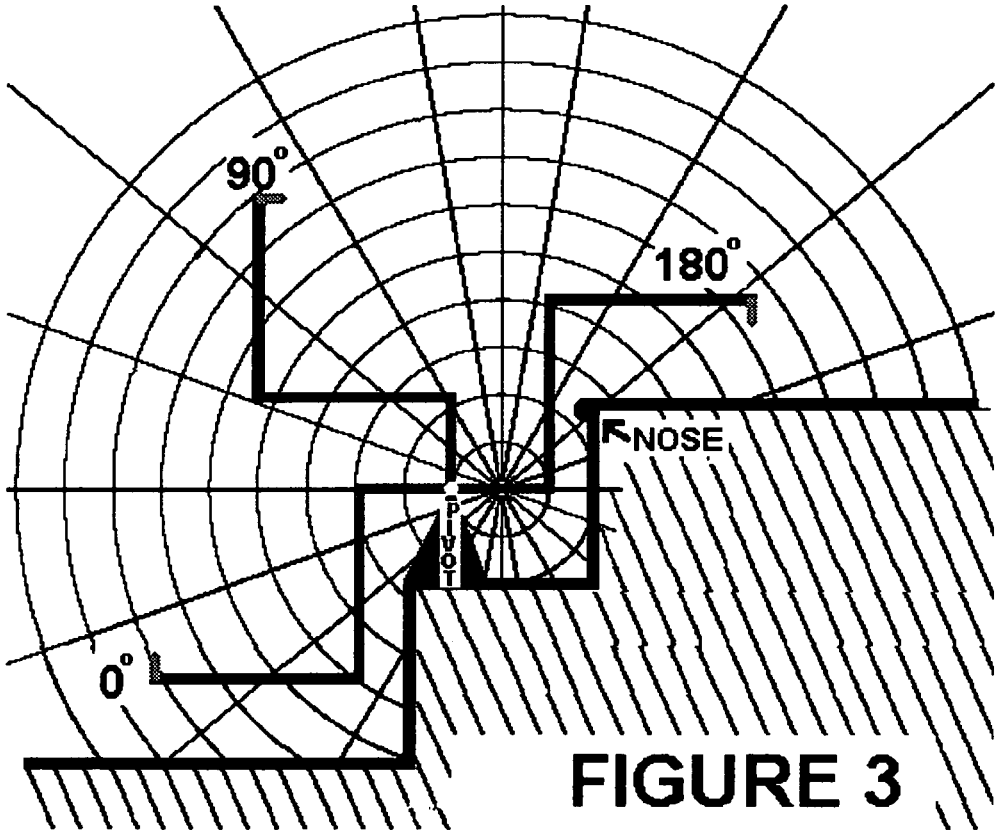
FIG. 3 and its inset

Referring now to FIG. 3 showing details of Step-Shaped Lift Shaft 160. Many porch steps have an odd number of steps. This means that one step is the center step and there are an equal number of flat levels above that step as below that center step. In these cases, the number of bends above the center step is the same as below the center step. Each step comprises a near level face and a near vertical face, which are dimensionally called the tread run and the rise, respectively. For the purposes here, as steps are generally slightly sloped, the terms near level and near vertical include both horizontal and vertical faces respectively, as well as faces angularly near horizontal and vertical. Each level face forms the same near right angle, or a true right angle to both the near vertical face above it and the near vertical face below it. Therefore, each near vertical face is equidistance and equiangular to each other near vertical face and each near level face is equidistance and equiangular to each other near level face. In practice, staircase, porch and threshold steps are available in both right angle and non-right angle configurations, that here are together called 'near perpendicular.' For such purposes here, 'near perpendicular' includes both right angle and non-right angle configurations.

In such a case, a line drawn from the midpoint of the center step toward the near vertical face below the step, and then continuing the line down that near vertical face to the midpoint of the next lower step forms a rectilinear bent radius from the center step to the midpoint of the next lower step.

This is demonstrated in FIG. 3 by rotating the line described above to make a similarly drawn line but backwards from the midpoint of the center step toward the vertical face above it and then up that face and along to the midpoint of the next near level face above the center step. The bent radius is rectilinear because the lines forming the bent radius are straight, regardless of the angles between the lines.

In such a case of equidistance and equiangular faces, the bent radius rotating from the lower position to the upper position (or vice versa) circumscribes a circumference over the steps.

By placing a motor with the motor shaft extending along the face on the center step, as shown by the pivot point of FIG. 3 and attaching this rectilinear line, the center step becomes the center of a radial lift transport. Such a line could be called a Step-Shaped Lift Shaft and would at the terminal transit points (0 degrees and 180 degrees) lie parallel over the steps, or nearly parallel as in practice steps are often gently sloped. As shown in FIG. 3, a perpendicular line placed at the end of the Step-Shaped Lift Shaft stays tangential to the radial path. If the perpendicular line is replaced with a pivotally leveled platform, the platform moves circumferentially about the center step as the Step-Shaped Lift Shaft rotates.

Figure 2D:
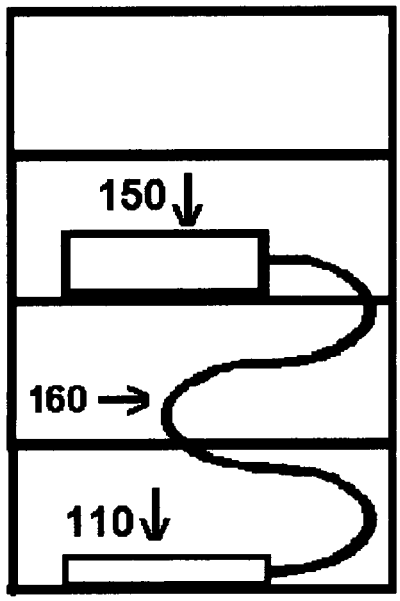
Figure 2E:
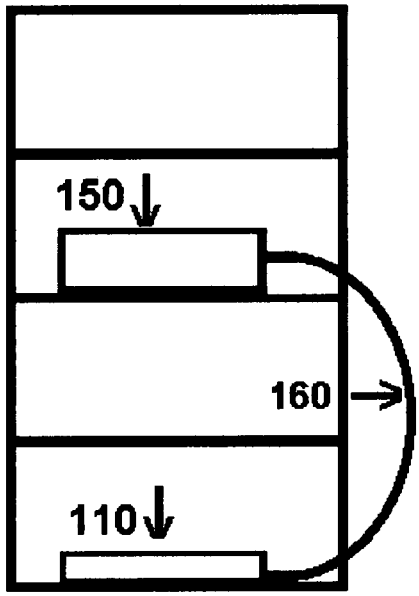
Figure 2F:
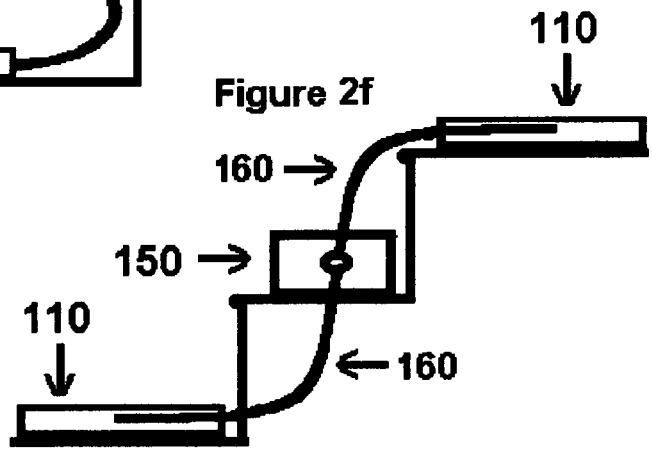
Figure 3A:
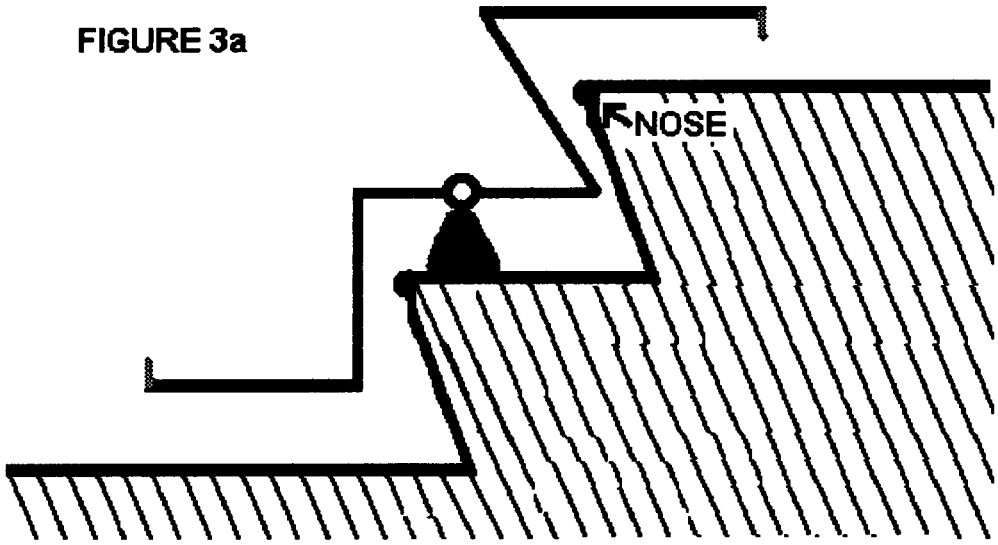
FIG. 3*a* is a detailed drawing of the Step-Shaped Lift Shaft showing the individual leg positions as the Step-Shaped Lift Shaft rotates over the steps.

The Step-Shaped Lift Shaft 160 allows use of the present invention directly and closely above an existing staircase, porch or threshold. Just as staircase, porch and threshold steps are joined at right angles and non-right angles, so too the Step-Shaped Lift Shaft 160 may be formed in right angle and non-right angle configurations. In practice, the elevation and centering of the Step-Shaped Lift Shaft 160 above the steps provides sufficient spacing that minor angular differences between the Step-Shaped Lift Shaft 160 and the steps do not interfere with proper operation of the present invention. Thus, a perpendicular configuration of the Step-Shaped Lift Shaft 160 would work where the step faces are not at right angles to each other, or where 'nosing' is present at the edge as shown in FIG. 3. Also, the elevation and spacing of the Step-Shaped Lift Shaft 160 above the steps compensates for variations in the tread run and rise. Furthermore, the Step-Shaped Lift Shaft 160 may be curvilinear as shown in FIG. 2*d* to the extent the nose of the step as shown in FIG. 3 does not stop its rotation. As shown in FIGS. 3 and 3*a*, the primary constraint is to avoid the Step-Shaped Lift Shaft 160 from striking the staircase. The precise angular configuration and placement of the Step-Shaped Lift Shaft 160 may be modeled to the angular configuration of the staircase of installation, which is easily ascertainable with standard construction measuring devices.

The Step-Shaped Lift Shaft 160 is formed of a tubular material as necessary for proper weight bearing needs. In many cases this is metal although various polymer tubing is available in straight and bent configurations for lighter applications. A significant advantage is that measurement of the steps is uncomplicated, and forming the Step-Shaped Lift Shaft 160 to the rise and tread run of the steps is generally inexpensive as many shops and craftsmen are capable of shaping the tubing.

This description of the present invention is not exhaustive or intended to limit the invention to the embodiments disclosed. Other modifications are possible in light of the above teaching. The embodiments described best explain the principles of the invention and its practical application to enable others skilled in the art to best use the invention in these embodiments and with modifications suited to the contemplated use.

What is claimed is:

1. A device for lifting and lowering a platform over at least one step comprising:

a step-shaped shaft having a first portion leg of the step-shaped shaft rotatably coupled to a motor;

a second portion leg of the step-shaped shaft substantially perpendicular to the first portion leg, the second portion leg interposed between the first portion leg and a third portion leg, with the second portion leg substantially perpendicular to the third portion leg;

the third portion leg of the step-shaped shaft pivotally coupled to a platform; and the motor attached to and above a top surface of a step for rotating the step-shaped shaft above the step.

2. A device for lifting and lowering a platform over at least one step comprising:

a curvilinear shaft having a first portion leg of the curvilinear shaft rotatably coupled to a motor;

a second portion leg of the curvilinear shaft curvilinear to the first portion leg, the second portion leg interposed between the first portion leg and a third portion leg, with the second portion leg curvilinear to the third portion leg;

the third portion leg of the curvilinear shaft pivotally coupled to a platform; and the motor attached to and above a top surface of a step for rotating the curvilinear shaft above the step.

* * * * *